US008777021B1

(12) United States Patent
Smith

(10) Patent No.: US 8,777,021 B1
(45) Date of Patent: Jul. 15, 2014

(54) ARCHERY EQUIPMENT HOLDING ASSEMBLY

(76) Inventor: Gordon Smith, West Monroe, LA (US)

( * ) Notice: Subject to any disclaimer, the term of this patent is extended or adjusted under 35 U.S.C. 154(b) by 166 days.

(21) Appl. No.: 13/468,567

(22) Filed: May 10, 2012

(51) Int. Cl.
*A47F 7/00* (2006.01)

(52) U.S. Cl.
USPC ..... 211/85.7; 211/60.1; 248/311.2

(58) Field of Classification Search
CPC ..... F41B 5/00; F41B 5/14; F41B 5/20
USPC ..... 211/85.7, 13.1, 60.1, 62, 64, 69.4, 69.5; 124/86, 23.1; 248/309.1, 169, 463, 248/311.2, 314, 315
See application file for complete search history.

(56) References Cited

U.S. PATENT DOCUMENTS 2,593,789 A * 4/1952 Pearson ..... 211/85.7
4,156,496 A * 5/1979 Stinson ..... 124/25.7
D299,199 S * 1/1989 Rogowski ..... D6/552
5,370,240 A * 12/1994 Hand ..... 211/13.1
5,558,043 A * 9/1996 Givens ..... 119/519
5,725,106 A * 3/1998 Wilson ..... 211/13.1
5,983,879 A * 11/1999 Gifford ..... 124/1
6,076,782 A * 6/2000 Alderman ..... 248/97
6,726,160 B1 * 4/2004 Buchanan, Jr. ..... 248/156
6,948,694 B1 * 9/2005 Gilbert ..... 248/530
D583,518 S * 12/2008 Thorner ..... D30/151
7,857,279 B2 * 12/2010 Krasnicki ..... 248/545
2004/0149867 A1 8/2004 Johnson
2010/0300421 A1 * 12/2010 LoRocco ..... 124/86

* cited by examiner

*Primary Examiner* — Korie H Chan
(74) *Attorney, Agent, or Firm* — R. Keith Harrison

(57) ABSTRACT

An archery equipment holding assembly including an assembly base; an arrow support frame carried by the assembly base, the arrow support frame disposed within an arrow support frame plane; at least one arrow rest assembly carried by the arrow support frame; a bow support frame carried by the assembly base, the bow support frame disposed within a bow support frame plane, the bow support frame plane disposed in generally perpendicular relationship to the arrow support frame plane and bisecting the arrow support frame plane into approximately equal halves; and a bow rest assembly carried by the bow support frame.

17 Claims, 5 Drawing Sheets

ARCHERY EQUIPMENT HOLDING ASSEMBLY

FIELD

Illustrative embodiments of the disclosure generally relate to archery equipment. More particularly, illustrative embodiments of the disclosure relate to an archery equipment holding assembly which supports an archery bow and arrows in an organized, accessible and secure manner.

BACKGROUND

Archery has been popular among enthusiasts of all abilities for millennia. In target shooting or hunting using archery equipment and accessories, it is frequently necessary for an archer to set a bow down in order to perform a task such as retrieve an arrow for placement in the bow. Many archers, particularly those having expensive and high-precision bows, prefer not to lay the bow on the ground or lean the bow against a tree or other support as he or she retrieves the arrow or performs the task. Placement of the bow on the ground or against a tree or other support may damage or adversely affect the finely-adjusted position of a scope or other component on the bow, particularly in the event that the bow inadvertently falls over when leaning against a tree or support.

Accordingly, an archery equipment holding assembly which supports an archery how and arrows in an organized, accessible and secure manner is desirable for various archery applications.

SUMMARY

The disclosure is generally directed to an archery equipment holding assembly. The archery equipment holding assembly may include an assembly base; an arrow support frame carried by the assembly base, the arrow support frame disposed within an arrow support frame plane; at least one arrow rest assembly carried by the arrow support frame; a bow support frame carried by the assembly base, the bow support frame disposed within a bow support frame plane, the bow support frame plane disposed in generally perpendicular relationship to the arrow support frame plane and bisecting the arrow support frame plane into approximately equal halves; and a bow rest assembly carried by the bow support frame.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
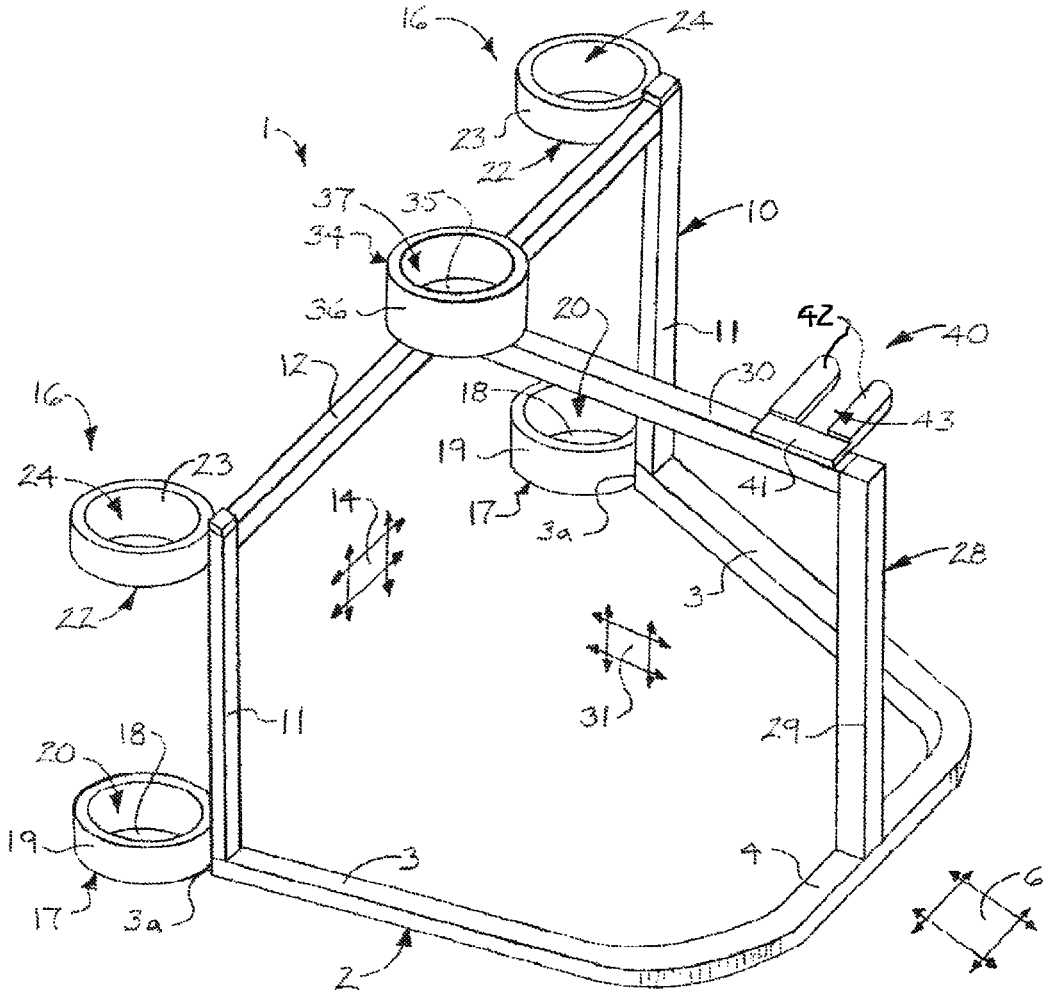
FIG. 1 is a perspective view of an illustrative embodiment of the archery equipment holding assembly.
Figure 2:
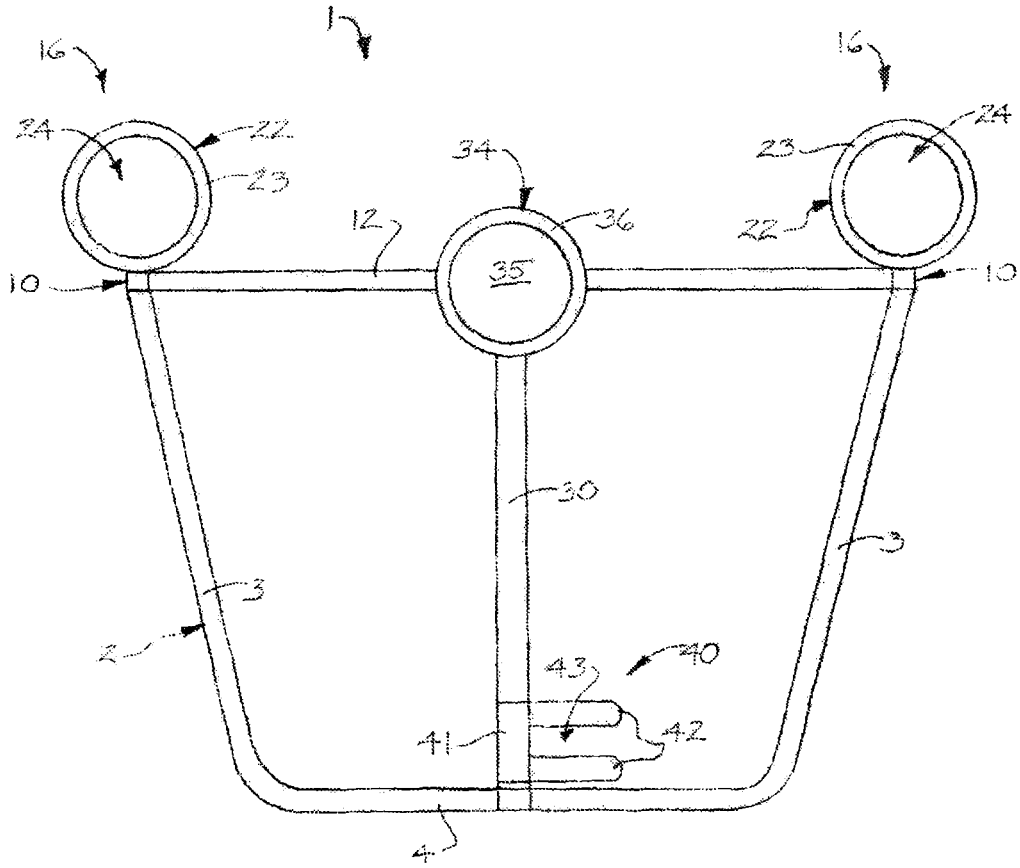
FIG. 2 is a top view of an illustrative embodiment of the archery equipment holding assembly.
Figure 3:
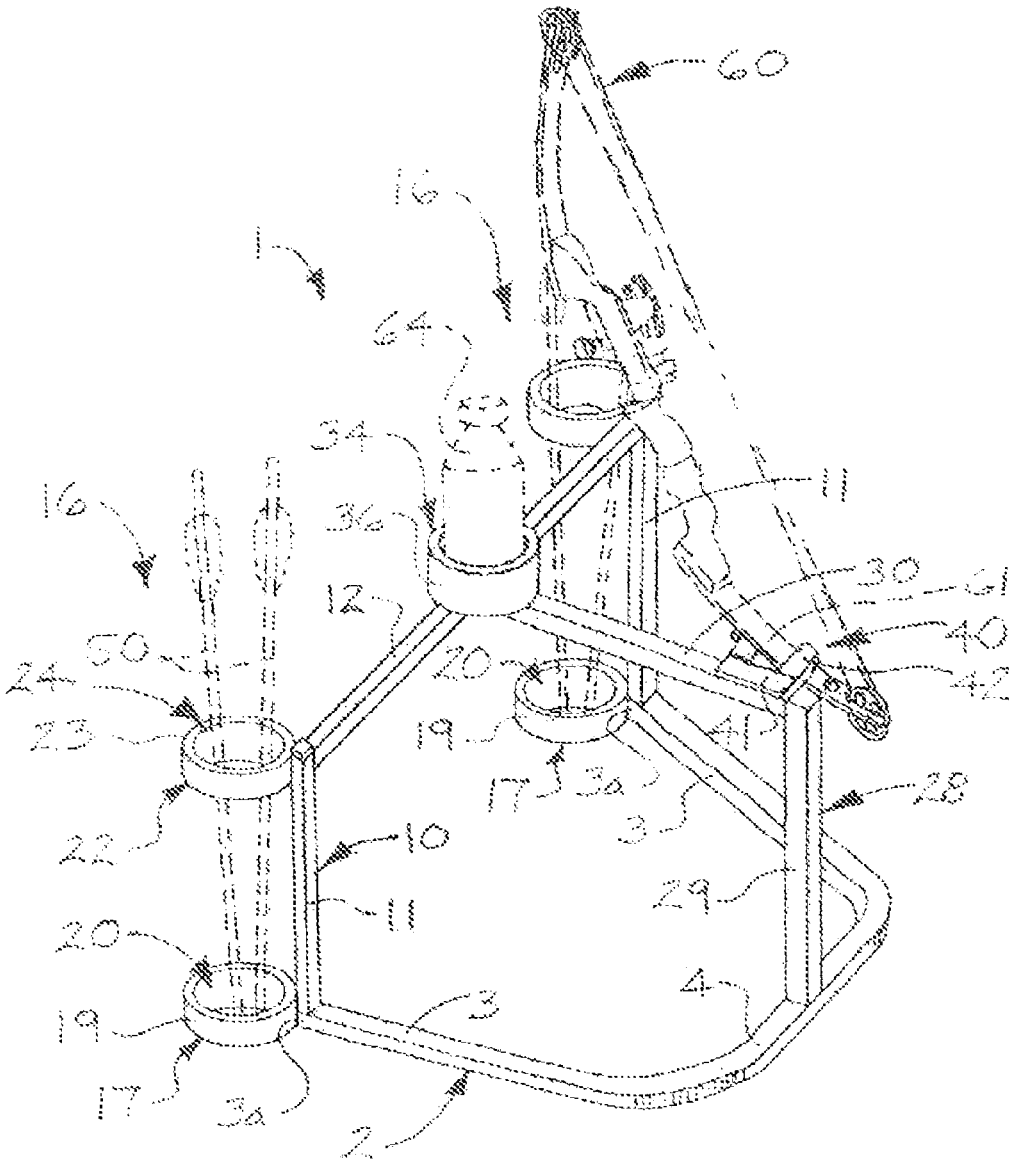
FIG. 3 is a perspective view of an illustrative embodiment of the archery equipment holding assembly in exemplary application of the assembly.

Referring initially to FIGS. 1-3 of the drawings, an illustrative embodiment of the archery equipment holding assembly, hereinafter assembly, is generally indicated by reference numeral 1. The assembly 1 includes an assembly base 2. An arrow support frame 10 and a how support frame 28 are provided on the assembly base 2. As illustrated in FIG. 3 and will be hereinafter described, the arrow support frame 10 of the assembly 1 is adapted to hold one or multiple arrows 50 (illustrated in phantom) in a manner which is readily and easily accessible to an archer (not illustrated) during archery target practice or hunting, for example. The bow support frame 28 of the assembly 1 is adapted to hold a bow 60 (illustrated in phantom) in a secure and accessible manner as the archer accesses an arrow 50, for example. The assembly base 2, the arrow support frame 10 and the bow support frame 28 may be fabricated of steel, aluminum or other metal square tubing or may be fabricated of composite materials or plastic, for example and without limitation.

As further illustrated in FIG. 1, the assembly base 2 of the assembly 1 may be disposed. within an assembly base plane 6; the arrow support frame 10 may be disposed within an arrow support frame plane 14; and the bow support frame 28 may be disposed within a bow support frame plane 31. The bow support frame plane 31 may be disposed in generally perpendicular relationship to the arrow support frame plane 14 and may bisect the arrow support frame plane 14 into approximately equal halves. The arrow support frame plane 14 and the bow support frame plane 31 may be disposed in generally perpendicular relationship to the assembly base plane 6.

The assembly base 2 of the assembly 1 may be generally U-shaped with a pair of side base members 3 and a connecting base member 4 which connects the side base members 3. En some embodiments, the side base members 3 may extend from the connecting base member 4 in generally diverging relationship to each other, as illustrated. Each side base member 3 has a base member end 3*a*. As illustrated in FIG. 1, the side base members 3 and the connecting base member 4 of the assembly base 2 may be disposed within the assembly base plane 6.

The arrow support frame 10 of the assembly 1 may be generally elongated with a pair of generally elongated, upward-standing, parallel, spaced-apart vertical arrow support frame members 11. The vertical arrow support frame members 11 may define a width of the arrow support frame 10. Each vertical arrow support member 11 may extend from the corresponding side base member 3 of the assembly base 2 at the base member end 3*a* thereof, as illustrated. A generally elongated horizontal arrow support frame member 12 may extend between the vertical arrow support frame members 11. The vertical arrow support frame members 11 may be attached to the respective side base members 3 and the horizontal arrow support frame member 12 may be attached to the vertical arrow support frame members 11 via welding, mechanical fasteners and/or other suitable attachment technique which is known by those skilled in the art. In some embodiments, the vertical arrow support frame members 11 and the horizontal arrow support frame member 12 may be casted, molded or otherwise fabricated in one piece according to the knowledge of those skilled in the art. As illustrated in FIG. 1, the vertical arrow support frame members 11 and the horizontal arrow support frame member 12 of the arrow support frame 10 may be disposed within the arrow support frame plane 14.

The bow support frame 28 of the assembly 1 may include a generally elongated vertical bow support frame member 29 which is upward-standing from the connecting base member 4 of the assembly base 2. A generally elongated horizontal bow support frame member 30 may extend between the vertical bow support frame member 29 and the horizontal arrow support frame member 12 of the arrow support frame 10. The vertical bow support frame member 29 and the horizontal bow support frame member 30 of the bow support frame 28 may be disposed within the bow support frame plane 31.

At least one arrow rest assembly 16 is provided on the arrow support frame 10. Each arrow rest assembly 16 may include an arrow rest cup 17 and an arrow rest collar 22 which is generally above or in vertically-spaced relationship to the arrow rest cup 17. The arrow rest cup 17 may have a cup bottom 18, a circular or alternatively-shaped cup wall 19 which is upward-standing from the cup bottom 18 and a cup interior 20 formed by the cup bottom 18 and the cup wall 19. The arrow rest collar 22 may have an annular or alternatively-shaped collar wall 23 and a collar opening 24 defined by the collar wall 23. As illustrated in FIG. 1, the cup interior 20 of the arrow rest cup 17 generally aligns or registers with the collar opening 24 of the arrow rest collar 22. The arrow rest cup 17 and the arrow rest collar 22 of each arrow rest assembly 16 may be attached to the arrow support frame 10 using welding, mechanical fasteners and/or other suitable alternative attachment technique known by those skilled in the art. In alternative embodiments, the arrow rest cup 17 and the arrow rest collar 22 may be fabricated in one piece with the arrow support frame 10 via casting, molding and/or other fabrication technique. In some embodiments, the bow support frame 28 may be disposed generally equidistant between the arrow rest assemblies 16, as illustrated.

In some embodiments, a pair of arrow rest assemblies 16 is provided on the arrow support frame 10 in spaced-apart relationship to each other. Accordingly, the arrow rest cup 17 of each arrow rest assembly 16 may be attached to a lower end portion of the corresponding vertical arrow support frame member 11 of the arrow support frame 10 generally at the base member end 3*a* of the corresponding side base member 3 of the assembly base 2. The arrow rest collar 22 of each arrow rest assembly 16 may be attached to an upper end portion of the corresponding vertical arrow support frame member 11 generally at the horizontal arrow support frame member 12 of the arrow support frame 10.

As further illustrated in FIGS. 1 and 2, at least one beverage container holder 34 may be provided on the arrow support frame 10 and/or the bow support frame 28 of the assembly 1 for the purpose of holding at least one beverage container 64 (FIG. 3). In some embodiments the beverage container holder 34 may include a holder bottom 35, a holder wall 36 upward-standing from the holder bottom 35 and a holder interior 37 formed by the holder bottom 35 and the holder wall 36. In other embodiments, the beverage container holder 34 may have any other design or configuration which is suitable for supporting a beverage container 64 for access by a consumer. In some embodiments, at least one beverage container holder 34 may be provided on the horizontal arrow support frame member 12 of the arrow support frame 10 generally equidistant between the arrow rest assemblies 16. In some embodiments, at least one beverage container holder 34 may be provided generally at the junction of the horizontal bow support frame member 30 of the bow support frame 28 with the horizontal arrow support frame member 12 of the arrow support frame 10. In other embodiments, at least one beverage container holder 34 may be provided at any point along the horizontal arrow support frame member 12 of the arrow support frame 10 and/or at any point along the horizontal bow support frame member 30 of the how support frame 28, for example and without limitation.

A bow rest assembly 40 is provided on the bow support frame 28. The bow rest assembly 40 may have any design which is suitable for detachably supporting the bow 60 on the bow support frame 28. In some embodiments, the bow rest assembly 40 may include a bow rest assembly base plate 41. The bow rest assembly base plate 41 may be attached to the horizontal how support frame member 30 of the how support frame 28 via welding, mechanical fasteners and/or other suitable alternative attachment technique. A pair of generally elongated, spaced-apart how rest assembly flanges 42 extends from the bow rest assembly base plate 41. A flange space 43 is defined by and between the bow rest assembly flanges 42. Each bow rest assembly flange 42 may be oriented in generally perpendicular relationship to a longitudinal axis of the horizontal bow support frame member 30 of the bow support frame 28. In alternative embodiments, the bow rest assembly 40 may include one or more clamps, clips, hooks, magnets, brackets and/or other mechanical fasteners which facilitate removable attachment of the bow 60 to the bow support frame 28.

Referring next to FIG. 3 of the drawings, exemplary application of the assembly 1 is illustrated. The assembly base 2 of the assembly 1 is placed on level ground (not illustrated) or other flat surface preparatory to archery target practice or hunting. A bow 60 (illustrated in phantom) is supported on the bow support frame 28 of the assembly 1 by inserting the how frame 61 of the bow 60 through the flange space 43 between the spaced-apart bow rest assembly flanges 42 of the bow rest assembly 40. Accordingly, the bow frame 61 may extend beneath one bow rest assembly flange 42 and over the other bow rest assembly flange 42 of the bow rest assembly 40 such that the bow rest assembly flanges 42 retain the bow 60 on the horizontal bow support frame member 30 of the bow rest assembly 40.

At least one arrow 50 (illustrated in phantom) may be supported by each arrow rest assembly 16. Each arrow 50 may be placed in an arrow rest assembly 16 by extending the arrow 50 through the collar opening 24 of the arrow rest collar 22 and resting the tip of each arrow 50 on the cup bottom 18 in the cup interior 20 of the corresponding arrow rest cup 17. Accordingly, an archer (not illustrated) can readily select, access and retrieve an arrow 50 from one of the arrow rest assemblies 16 as the bow 60 remains securely attached to the bow support frame 28. After the arrow 50 is retrieved from the arrow rest assembly 16, the archer typically removes the bow 60 from the bow rest assembly 40, places the arrow 50 in the bow 60, aims and shoots the arrow 50 from the bow 60. Because the bow support frame 28 may be disposed generally equidistant between the arrow rest assemblies 16 of the assembly 1, the bow 60 may be positioned between the arrows 5Q such that the arrows 50 are highly visible and accessible to an archer without physical interference by the bow 60, and vice-versa. A beverage container 64 (illustrated in phantom) may be placed in the holder interior 37 and rested on the holder bottom 35 of the beverage container holder 34 for case of access and retrieval as desired.

Figure 4:
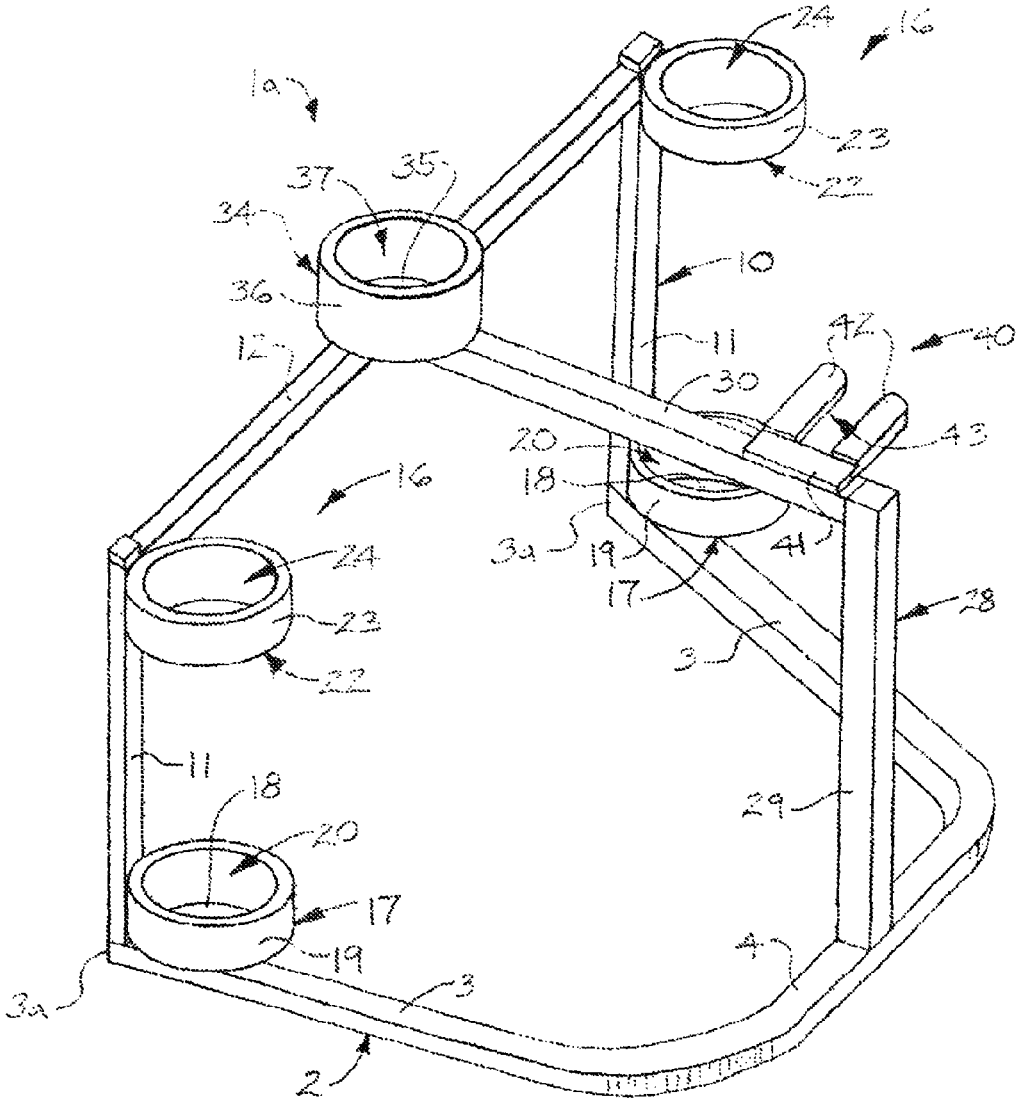
FIG. 4 is a perspective view of an alternative illustrative embodiment of the archery equipment holding assembly.

Referring next to FIG. 4 of the drawings, an alternative illustrative embodiment of the archery equipment holding assembly is generally indicated by reference numeral 1*a*. The assembly 1*a* may be similar in design to the assembly 1 which was heretofore described with respect to FIGS. 1-3. In the assembly 1*a*, the arrow rest cup 17 and the arrow rest collar 22 of each arrow rest assembly 16 may be oriented on the opposite side of the arrow support frame 10 with respect to that of the assembly 1 in FIGS. 1-3. Application of the assembly 1*a* may be as was heretofore described with respect to the assembly 1 in FIG. 3.

Figure 5:
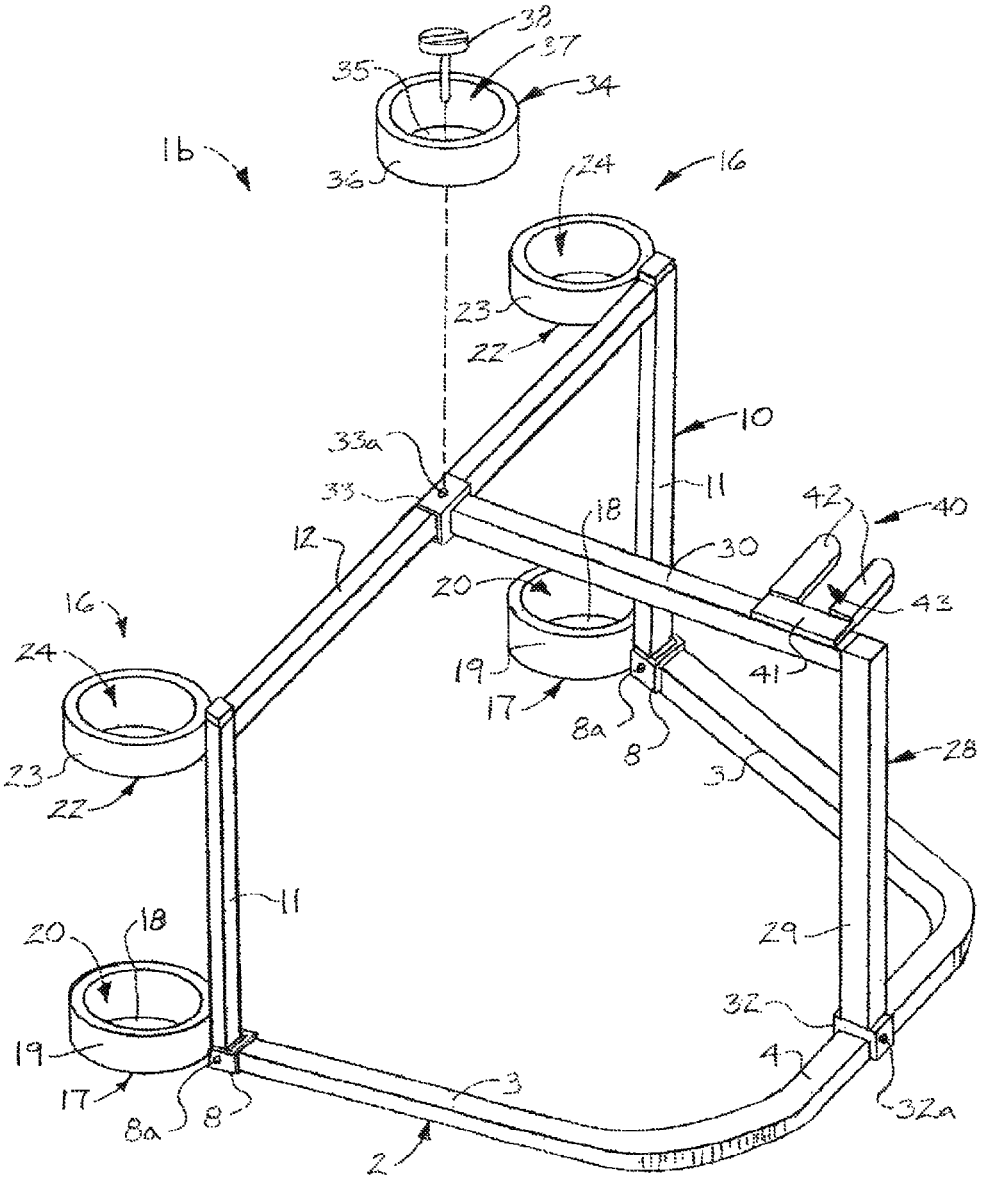
FIG. 5 is an exploded perspective view of another alternative illustrative embodiment of the archery equipment holding assembly.

Referring next to FIG. 5 of the drawings, another alternative illustrative embodiment of the archery equipment holding assembly is generally indicated by reference numeral 1*b*. The assembly 1*b* may be similar in design to the assembly 1 which was heretofore described with respect to FIGS. 1-3. In the assembly 1*b*, the arrow support frame 10 and the bow support frame 28 may be detachably attached to the assembly base 2 and each other. Accordingly, a clamp bracket 8 may terminate each side base member 3 of the assembly base 2. A clamp pin 8*a* may be extended through registering pin openings (not illustrated) in the clamp bracket 8 and the corresponding vertical arrow support frame member 11 of the arrow support frame 10 to detachably attach the vertical arrow support frame member 11 of the arrow support frame 10. Similarly, a clamp bracket 32 may terminate the vertical bow support frame member 29 of the bow support frame 28. A clamp pin 32*a* may be extended through registering pin openings (not illustrated) in the clamp bracket 32 and the connecting base member 4 of the assembly base 2 to detachably attach the bow support frame 28 to the assembly base 2. A clamp bracket 33 may terminate the horizontal how support frame member 30 of the bow support frame 28. A fastener opening 33*a* may be provided in the clamp bracket 33. A fastener 38 may be extended through the fastener opening 33*a* to detachably attach the bow support frame 28 to the arrow support frame 10. As further illustrated in FIG. 5, in some embodiments the fastener 38 may be extended through a fastener opening (not illustrated) in the holder bottom 35 of the beverage container holder 34 to attach the beverage container holder 34 to the arrow support frame 10.

While illustrative embodiments of the disclosure have been described above, it will be recognized and understood that various modifications can be made in the disclosure and the appended claims are intended to cover all such modifications which may fall within the spirit and scope of the disclosure.

What is claimed is:

1. An archery equipment holding assembly, comprising:

an assembly base;

an arrow support frame carried by the assembly base, the arrow support frame defining an arrow support frame plane;

at least one arrow rest assembly carried by the arrow support frame;

a bow support frame carried by the assembly base, the bow support frame disposed within a bow support frame plane;

wherein the bow support frame plane is disposed in generally perpendicular relationship to the arrow support frame plane and bisects the arrow support frame plane into approximately equal halves;

a bow rest assembly carried by the bow support frame; and at least one beverage container holder carried by at least one of the arrow support frame and the bow support frame.

2. The archery equipment holding assembly of claim 1 wherein the at least one arrow rest assembly comprises a pair of spaced-apart arrow rest assemblies.

3. The archery equipment holding assembly of claim 1 wherein the at least one arrow rest assembly comprises an arrow rest cup and an arrow rest collar spaced-apart with respect to the arrow rest cup.

4. The archery equipment holding assembly of claim 3 wherein the arrow rest cup comprises an arrow rest cup bottom, a cup wall extending from the arrow rest cup bottom and a cup interior formed by the arrow rest cup bottom and the cup wall.

5. The archery equipment holding assembly of claim 4 wherein the arrow rest collar comprises a collar opening generally registering with the cup interior of the arrow rest cup.

6. The archery equipment holding assembly of claim 1 wherein the bow rest assembly comprises a pair of spaced-apart bow rest assembly flanges and a flange space between the bow rest assembly flanges.

7. The archery equipment holding assembly of claim 1 further comprising a first pair of clamp brackets carried by the assembly base and detachably engaging the arrow support frame and a second pair of clamp brackets carried by the bow support frame and detachably engaging the assembly base and the arrow support frame, respectively.

8. An archery equipment holding assembly, comprising:

a generally U-shaped assembly base disposed within an assembly base plane;

a generally elongated arrow support frame carried by the assembly base, the arrow support frame defining an arrow support frame plane generally perpendicular to the assembly base plane;

a pair of spaced-apart arrow rest assemblies carried by opposite ends of the arrow support frame, each of the arrow rest assemblies including an arrow rest cup and an arrow rest collar spaced-apart with respect to the arrow rest cup;

a bow support frame carried by the assembly base, the bow support frame disposed within a bow support frame plane;

wherein the bow support frame plane is disposed in generally perpendicular relationship to the arrow support frame plane and bisects the arrow support frame plane into approximately equal halves; and a bow rest assembly carried by the bow support frame.

9. The archery equipment holding assembly of claim 8 wherein the arrow rest cup comprises an arrow rest cup bottom, a cup wall extending from the arrow rest cup bottom and a cup interior formed by the arrow rest cup bottom and the cup wall.

10. The archery equipment holding assembly of claim 9 wherein the arrow rest collar comprises a collar opening generally registering with the cup interior of the arrow rest cup.

11. The archery equipment holding assembly of claim 8 further comprising at least one beverage container holder carried by at least one of the arrow support frame and the bow support frame.

12. The archery equipment holding assembly of claim 8 wherein the bow rest assembly comprises a pair of spaced-apart bow rest assembly flanges and a flange space between the bow rest assembly flanges.

13. The archery equipment holding assembly of claim 8 further comprising a first pair of clamp brackets carried by the assembly base and detachably engaging the arrow support frame and a second pair of clamp brackets carried by the bow support frame and detachably engaging the assembly base and the arrow support frame, respectively.

14. An archery equipment holding assembly, comprising:

a generally U-shaped assembly base having a connecting base member and a pair of side base members extending from the connecting base member, the assembly base disposed within an assembly base plane;

a generally elongated arrow support frame having a pair of spaced-apart vertical arrow support frame members carried by the side base members, respectively, of the assembly base and a horizontal arrow support frame member carried by the vertical arrow support frame members, the arrow support frame defining an arrow support frame plane generally perpendicular to the assembly base plane;

a pair of spaced-apart arrow rest assemblies carried by the vertical arrow support frame members, respectively, of the arrow support frame, each of the arrow rest assemblies including an arrow rest cup and an arrow rest collar disposed in vertically spaced-apart relationship with respect to the arrow rest cup;

a bow support frame having a vertical bow support frame member carried by the connecting base member of the assembly base and a horizontal bow support frame member carried by the vertical bow support frame member and the horizontal arrow support frame member of the arrow support frame, the bow support frame disposed within a bow support frame plane;

wherein the bow support frame plane is disposed in generally perpendicular relationship to the arrow support frame plane and bisects the arrow support frame plane into approximately equal halves;

wherein the bow support frame is disposed generally equidistant between the arrow rest assemblies; and a bow rest assembly carried by the bow support frame.

15. The archery equipment holding assembly of claim 14 further comprising at least one beverage container holder carried by at least one of the arrow support frame and the bow support frame.

16. The archery equipment holding assembly of claim 14 wherein the bow rest assembly comprises a pair of spaced-apart bow rest assembly flanges carried by the horizontal bow support frame member of the bow support frame and a flange space between the bow rest assembly flanges.

17. The archery equipment holding assembly of claim 14 further comprising a first pair of clamp brackets carried by the side base members, respectively, of the assembly base and detachably engaging the vertical arrow support frame members, respectively, of the arrow support frame; and a second pair of clamp brackets carried by the vertical bow support frame member and the horizontal bow support frame member, respectively, of the bow support frame and detachably engaging the connecting base member of the assembly base and the horizontal arrow support frame member of the arrow support frame, respectively.

* * * * *